US008578674B2

(12) United States Patent
Ross

(10) Patent No.: US 8,578,674 B2
(45) Date of Patent: Nov. 12, 2013

(54) BRACER SPACER

(76) Inventor: Frankie Laine Ross, Walnut Creek, CA (US)

( * ) Notice: Subject to any disclaimer, the term of this patent is extended or adjusted under 35 U.S.C. 154(b) by 0 days.

(21) Appl. No.: 13/284,946

(22) Filed: Oct. 30, 2011

(65) Prior Publication Data

US 2013/0104497 A1 May 2, 2013

(51) Int. Cl.
*E04D 1/00* (2006.01)

(52) U.S. Cl.
USPC ..... 52/553; 52/126.7

(58) Field of Classification Search
USPC ..... 52/749.11, 747.11, 553, 126.4, 126.7; 33/526, 527
See application file for complete search history.

(56) References Cited

U.S. PATENT DOCUMENTS 1,139,119 A * 5/1915 Heidenreich ..... 446/256
2,031,684 A * 2/1936 Berger ..... 52/396.1
2,797,495 A * 7/1957 Walston ..... 33/518
3,025,934 A * 3/1962 Spiselman et al. ..... 52/126.6
3,511,001 A * 5/1970 Morgan, Jr. ..... 52/126.5
4,397,125 A * 8/1983 Gussler, Jr. ..... 52/127.3
4,503,654 A * 3/1985 Cosentino ..... 52/747.11
4,558,544 A * 12/1985 Albrecht et al. ..... 52/126.6
4,793,068 A * 12/1988 Golkar ..... 33/526
4,953,341 A * 9/1990 Joos ..... 52/747.11
4,955,142 A * 9/1990 Rieck ..... 33/526
5,288,534 A * 2/1994 Tavshanjian ..... 428/64.1
5,359,783 A * 11/1994 Smith ..... 33/527
5,479,745 A * 1/1996 Kawai et al. ..... 52/126.6
5,542,219 A * 8/1996 Dias ..... 52/126.4
5,603,195 A * 2/1997 Cosentino ..... 52/749.11
5,607,256 A * 3/1997 McCleary ..... 404/105
5,623,799 A * 4/1997 Kowalski et al. ..... 52/392
5,675,942 A * 10/1997 Crawford ..... 52/127.3
5,701,680 A * 12/1997 Garcia et al. ..... 33/526
5,832,619 A * 11/1998 Volkema, Jr. ..... 33/527
5,966,781 A * 10/1999 Geiger ..... 24/16 PB
6,000,184 A * 12/1999 Fernandes ..... 52/389
6,256,939 B1 * 7/2001 Snyder ..... 52/126.6
6,332,292 B1 * 12/2001 Buzon ..... 52/126.6
6,363,685 B1 * 4/2002 Kugler ..... 52/745.05
6,412,185 B1 * 7/2002 Mills et al. ..... 33/526
D466,380 S * 12/2002 Dickson ..... D8/14
6,625,951 B1 * 9/2003 McCarthy ..... 52/747.1
6,647,685 B2 * 11/2003 Annarella et al. ..... 52/392
6,704,972 B2 * 3/2004 Pyle ..... 24/16 PB
D492,210 S * 6/2004 Shilo et al. ..... D10/64
6,796,049 B1 * 9/2004 Claxton ..... 33/527
6,874,242 B2 * 4/2005 Shilo et al. ..... 33/526
7,257,926 B1 * 8/2007 Kirby et al. ..... 52/126.5
7,454,869 B2 * 11/2008 Owen ..... 52/263
7,536,802 B1 * 5/2009 Tavy et al. ..... 33/527

(Continued)

*Primary Examiner* — William Gilbert
*Assistant Examiner* — James Ference
(74) *Attorney, Agent, or Firm* — William A. Jeckle

(57) ABSTRACT

A device for spacing, bracing and leveling tiles during installation on a ceiling substrate, comprises a, spacer and a bracer having a threaded substrate penetrating screw to releasably engage with the substrate for bracing and leveling tiles. The spacer and bracer are made of rigid material to support the weight of tile. The spacer carries at least one spacer ridge that when placed between tiles will create an equal distance between adjacent tiles. When the screw is inserted through a hole defined in the spacer and screwed until a first surface of the spacer frictionally contacts an exposed surface of the tile, the spacer will secure the tile and prevent a ceiling tile from falling until an adhesive dries.

14 Claims, 13 Drawing Sheets

(56) References Cited

U.S. PATENT DOCUMENTS

| | | | | |
|---|---|---|---|---|
| 7,621,100 | B2 * | 11/2009 | Kufner et al. | 52/749.11 |
| 7,650,700 | B1 * | 1/2010 | Blankenship | 33/527 |
| 7,694,670 | B2 * | 4/2010 | Smith | 125/23.01 |
| D630,077 | S * | 1/2011 | Kufner et al. | D8/105 |
| D630,078 | S * | 1/2011 | Kufner et al. | D8/105 |
| 7,946,093 | B1 * | 5/2011 | Sturino | 52/749.11 |
| 7,992,354 | B2 * | 8/2011 | Doda, Jr. | 52/127.7 |
| 8,011,164 | B2 * | 9/2011 | Kufner et al. | 52/749.11 |
| 2002/0121027 | A1 * | 9/2002 | Kruskamp | 33/526 |
| 2004/0060184 | A1 | 4/2004 | Shilo et al. | |
| 2004/0250435 | A1 * | 12/2004 | Fiore | 33/527 |
| 2006/0185319 | A1 * | 8/2006 | Kufner et al. | 52/749.11 |
| 2007/0227025 | A1 | 10/2007 | Venture | |
| 2008/0141617 | A1 * | 6/2008 | Joski | 52/749.11 |

* cited by examiner

BRACER SPACER

BACKGROUND

Professional and amateur installers of floor, wall and ceiling coverings that include ceramic tile, marble, granite, slate and other material commonly use spacers to create an equal distance between adjacent tiles. They also use an assortment of devices to level the tiles, which when leveled correctly will produce an even surface without lips across the entire surface area.

Laying or installing tile is a skilled craft. Professional and amateur tile installers can find the process of spacing and leveling tiles difficult and time consuming. And because of gravity, installing tiles on ceilings can be even more complex and dangerous for both professional and amateur installers. Without the proper tools and skill set, installation results can be inconsistent, unpredictable and non-repeatable. These are some of the reasons that installers do not commonly install tiles on ceilings, particularly above showers and bathtubs.

Leveling, which is the art of installing tiles so the tiles are flush with all adjacent tiles, is one of the most difficult aspect of installing tiles. Spacing, which is the process of ensuring that each tile has the same distance between each adjacent tile, is easy, even for amateurs. There are many different types and sizes of spacers on the market to choose from. The cross spacer and variations thereof, is the most commonly used to create an equal distance between adjacent tiles during the installation process. An installer can easily obtain spacers of almost any thickness that would provide the spacing that he/she would want between adjacent tiles. A known limitation of cross spacers is that their design, similar to a "+" makes them useful primarily on floors and walls. By taping each in place, the spacer could be used to space tiles on a ceiling. However, without a bracing device that retains the newly placed tiles in place the tiles will pull away from the ceiling and fall if an installer attempted to use a cross spacer for anything other than a spacing device on ceiling tile installations. The tiles will pull away from the ceiling because most commonly used adhesives are not strong enough to hold tiles securely in place until the adhesive dries. Although this problem has existed for many years, the market is absent a commercially viable solution that keeps spacers and tiles from falling when installing tiles on ceilings.

For example, U.S. Pat. No. 1,139,119 to Heidenreich (1915) is a toy top that could be useful as a crude form of a spacer. But the cost to use this toy as a spacer would be prohibitive and impractical. It comprises no features that would enable it be used as a tile spacer and as a bracing device.

U.S. Pat. No. 2,031,684 to Berger (1936), the cross spacer, is the most prevalent spacer type in use today. However, its primary usefulness is that of providing even spacing between tiles on floors, walls and tabletops and the like. It has no design features that would enable it to be used as a ceiling tile spacing and bracing device.

U.S. Pat. No. 2,797,495 to Walston (1957), a Glass Building Block Aligner could not possibly be used as a spacer or a bracer when installing ceiling tile in that it is not structurally capable of doing so. It aligns glass blocks.

U.S. Pat. No. 4,397,125 to Gussler Jr. (1983) discloses a system for aligning uneven thickness panel sections of floors, walls, ceilings and flat surfaces. Gussler's invention enables even alignment of uneven panel members using the floor as base support. The invention requires insertion of the device underneath material which must be in direct contact with panel members to create lift and alignment. The device must be set in a bonding compound until it has dried. This system would not be useful for installing ceramic tile, marble tile, granite tile and other hard material on a ceiling. This system has no design features that would prevent the ceiling tile from falling to the floor.

Another invention, U.S. Pat. No. 4,955,142 to Rieck (1990), discloses a deck spacing tool that appears to comprise a vertically extending blade with a pair of horizontally extending arms. It provides spacing during the installation of deck boards. This tool could not possibly be used to install ceiling tiles in that there is no apparatus to prevent the tiles from falling to the floor.

U.S. Pat. No. 5,288,534 to Tayshanjian (1994) is a derivative of the Berger type spacer of 1936 that is primarily used on floor surfaces or vertical walls. The ordinary purpose of this embodiment is that of a spacer. The spacer has no design features that hold tile in place during a ceiling tile installation.

U.S. Pat. No. 5,479,745 to Kawai (1996), floor panel support leg and double floor, apparently is useful for installing floors. There is no practical use of this invention to install ceiling tile in that it neither provides spacing nor an apparatus that would prevent a ceiling tile from falling before the adhesive dries.

U.S. Pat. No. 5,623,799 to Kowalski (1997), is a device and process for mounting tiles of varying thickness is an embodiment of the 1936 Berger spacer. This embodiment could not be used when installing ceiling tile in that it has no apparatus to prevent the tile from falling to the floor.

U.S. Pat. No. 0,466,380 to Dickson (2002) is an ornamental design for a ceramic wall and floor tile laying guide that has no practical application for the installation of ceiling tile. Dickson's invention has no features that would space or brace ceiling tiles and prevent the tiles from falling to the floor.

Dual spacing width tile spacers, U.S. patent publication 2004/0060184 to Shilo (2004), U.S. patent publication 2004/0250435 to Fiore (2004), U.S. Pat. No. 7,257,926 to Kirby (2007), U.S. patent publication 2007/0227025 to Venture (2007), adequately spaces tiles on walls, floors and tabletops, but do not have design features to support the installation of ceiling tile and prevent the tiles from falling to the floor.

U.S. Pat. No. 7,946,093 to Sturino (2008) spaces tiles and has an apparatus that adjusts the height of tiles. Sturine's invention is useful for laying tiles on floors, walls and tabletops, as does U.S. Pat. No. 7,536,802 to Tavy (2009); neither has design features to support the installation of ceiling tile and prevent the tiles from falling to the floor.

Similar inventions, U.S. Pat. No. 7,621,100 to Kufner (2009) adequately spaces and levels tiles, and U.S. Pat. No. 7,650,700 to Blankenship (2010), enables the installation of tiles on floors, walls and tabletops, but neither have features that would prevent tiles from falling to the floor when installing tiles on a ceiling.

Installers have in the past used crude processes to painstakingly secure tiles to ceilings. For example, after an installer attaches a bonding substrate to a ceiling to which adhesives or other bonding substances will adhere to, the subsequent process becomes more difficult. Next, installers apply their desired adhesive to a back surface of tile and while holding tile in one hand with the adhesive facing upward, push the tile onto the bonding substrate, twist and slide slightly into place to create a bond and suction. This crude process theoretically holds tiles in place until the adhesive has dried. This process is performed repeatedly until the entire surface area has been covered. However, many of the tiles will pull away from the ceiling because the adhesive is the only element keeping the tiles to the ceiling. Therefore, the use of a spacer becomes impractical, and even spacing between adjacent tiles becomes a problem. It is possible to tape a spacer between each tile, but that process is impractical and very time consuming. Another problem with this crude process is that there is no reasonably simple way to level the tiles. This method creates additional work for the installer, requires more time and increases the level of difficulty to complete the job. The results of using this method are inconsistent, unpredictable and hazardous. The danger is that one or more tiles could suddenly fall from the ceiling. The stickiness of the adhesive used and the force of suction are the only elements holding the tiles to the ceiling. As a result it becomes difficult for an installer utilizing this method to achieve consistently even spacing between adjacent tiles and to prevent lip-outs. There does not appear to be prior art devices that simultaneously spaces and braces tiles during installation on a ceiling.

Another crude method of installing tiles on a ceiling include the application of an adhesive to the back of tiles, pushing them to the bonding surface, aligning the tiles and then placing a pole or long stick underneath each tile to hold the tiles in place until the adhesive dries. While this method can hold the tiles in place and prevent them from falling, the inherent problem with this method is that the results will be inconsistent. The added cost of acquiring poles, sticks or other long straight objects makes this method expensive and very time consuming. In addition, leveling the tiles with equal spacing between adjacent tiles will be difficult and impractical.

This embodiment solves a recurring installation problem that previously had not been solved. This embodiment solves the problem by enabling installers to easily install tiles on ceilings that securely hold, spaces and levels tiles. It comprises a simple, very inexpensive, reusable device that improves consistency, saves time and reduces the cost of installing tiles on ceilings. It can also be used for tile installations on floors and walls as well. Thus, this embodiment will produce predictable and repeatable results.

SUMMARY

A Bracer Spacer provides professional and amateur tile installers with a simple tool that space, brace and level tiles during installation on ceilings, and also space and level tiles on floors and walls. For ceiling tile installations the Bracer Spacer comprises a spacer and a bracer that when used together will thereby prevent tiles from falling from the ceiling. This embodiment makes the ceiling tile installations quicker, safer, consistent and predictable.

In accordance with this embodiment, a bonding substrate is secured to a ceiling. Subsequently, the tile is "back-buttered" with an adhesive and put to the ceiling at the desired location. With the spacer sitting atop the bracer screw, spacer ridges up, the installer places the device to the midpoint edge of the tile being held, align the spacer ridge parallel to the tile, and screw the unit clockwise into the bonding substrate until snug. The screwing process can be done manually by hand, or by using a hand-held screwdriver or a cordless screwdriver. After securing a first side, the opposite side of the tile is secured in the exact same manner. This process is repeated until all of the tiles have been secured to the ceiling. After the adhesive has dried the bracer screw can be unscrewed and the spacer can be removed with it and used again for another project. The hole in the substrate adjacent the tile and caused by the bracer screw is filled with grout during the standard grouting procedure which commonly follows installation of the tiles.

Another aspect of this embodiment is to align tiles on walls and floors. In that the need for installers to require various spacing gaps between adjacent tiles, this embodiment is meant to include all spaces greater than one-hundred twenty eighth of an inch. When used as a spacer only, an installer would simply place the spacer between two adjacent tiles and move the tile until snug with the spacer ridge. To level tiles, an installer would simply place the bracer screw in the hole on the spacer, rotate the bracer and its attached threaded screw clockwise into the bonding substrate until the adjacent tiles are level with each other. After the adhesive has dried the bracer screw can be unscrewed and the spacer can be removed with it and used again for another project.

Several advantages of one or more aspects are as follows: to prevent ceramic tile, slate, marble, granite and other materials being installed on a ceiling from falling, that is very inexpensive, that provides consistent results, that can be used with or without a screwdriver, that saves time during the installation process, that unscrews easily for use again on another project, that can be used on almost any size tile, that will penetrate commonly used bonding substrates, that enables installers to work alone, that requires no additional tools or materials, that enables proper spacing between tiles, that allows tiles to be installed evenly horizontally, that can be easily manufactured, and is cost effective. These and other advantages of one or more aspects will be apparent from a consideration of the drawings and ensuing description.

DETAILED DESCRIPTION

Figure 1:
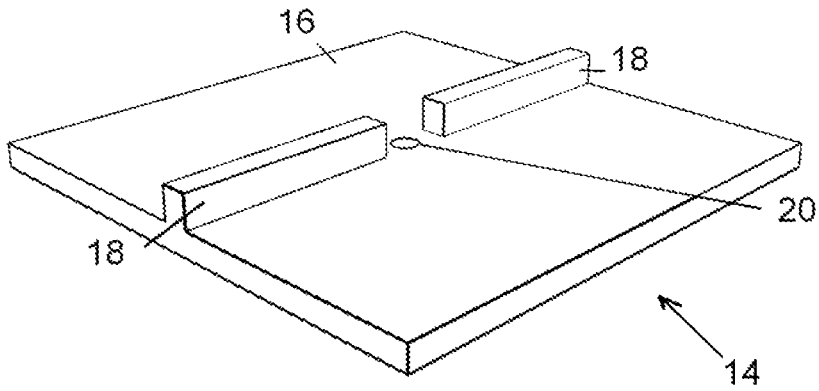
FIG. 1 is a perspective view of the spacer with two spacer ridges located on opposing sides of a centrally located hole defined in the base of the spacer.

FIG. 1 shows a perspective view of one embodiment of the spacer 14. The spacer 14 is approximately 38.1 mm square (1½") in FIG. 1 and may be made from high density polyethylene, available from U.S. Plastic Corporation in Lima, Ohio. However, the spacer 14 may also be made of other plastics and hard materials such as polypropylene, wood, iron, steel, and aluminum, compressed cardboard or other similar materials. Molded to the center of the spacer base 16 are two spacer ridges 18, approximately 1.5875 mm (1/16") thick in the preferred embodiment. The two spacer ridges 18 approximately 4.7625 mm (3/16") high and 12.7 mm (½") long are located at the middle of the spacer base 16, separated by a hole 20. The spacer ridge 18 can range from approximately 0.7938 mm (1/32") to 12.7 mm (½") wide or greater dependent upon the desired space between adjacent tiles. Between each spacer ridge 18 is a round through hole 20. The hole 20 has a diameter of approximately 0.3969 mm (1/64") to 12.3031 mm (31/64") or greater dependent upon the size of [a] screw [28] that will penetrate the hole [20]. The threaded bracer screw 28 is slightly smaller than the width of the spacer ridge 18.

Figure 2A:
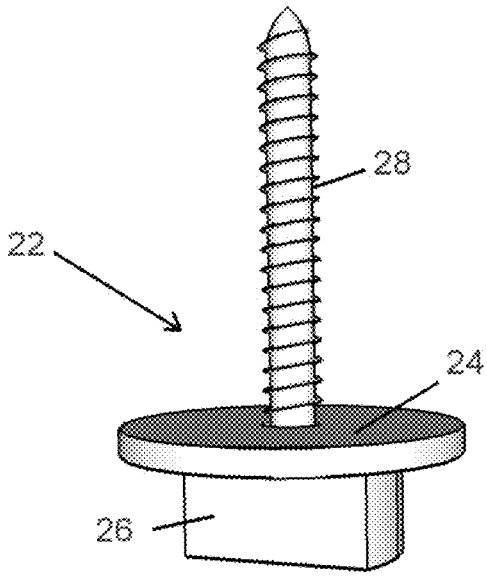
FIG. 2A is a perspective view of one embodiment of a bracer with a threaded screw, a circular bracer disc and a rectangular shaped curved end bracer grip.
Figure 2B:
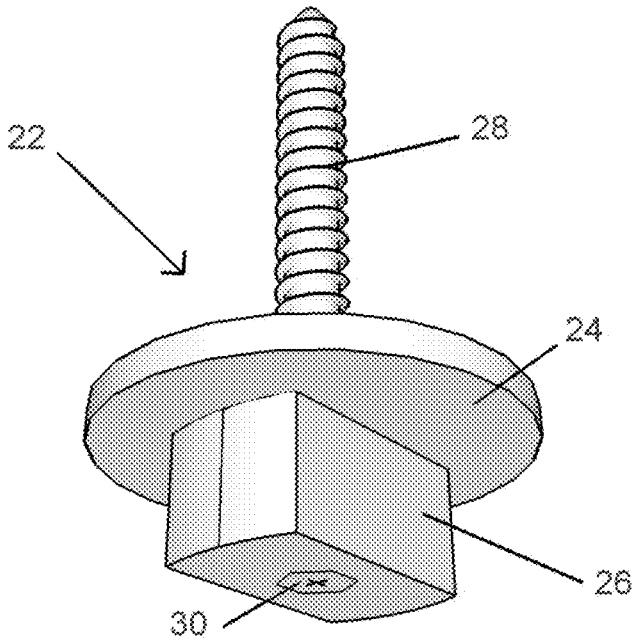
FIG. 2B is a perspective view of the bracer with a threaded screw, bracer disc and rectangular shaped curved end bracer grip. Also shown on the bracer grip is a hex screw head with Phillips screwdriver slot.
Figure 2C:
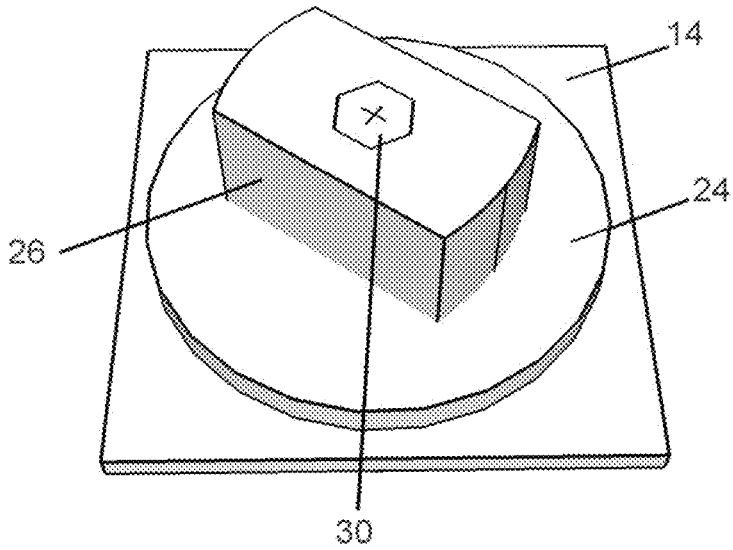
FIG. 2C is a top perspective view of the hex screw head with Phillips screwdriver slot atop the rectangular shaped curved end bracer grip attached to the bracer disc atop the spacer.

FIGS. 2A-2C shows side perspective and top perspective views of one embodiment of the bracer 22. The bracer 22 in FIG. 2A has a twisting means 26 shown as a bracer grip 26 comprised of high density polyethylene, available from U.S. Plastic Corporation. However, the twisting means bracer grip 26 may also consist of other plastics and hard material such as polypropylene, wood, iron, steel, aluminum, compressed cardboard or other similar materials. The bracer grip 26 is approximately 19.05 mm (¾") long, 12.7 mm (½") wide and 12.7 mm (½") high. Molded into the center of the bracer grip 26 is a threaded bracer screw 28 approximately 50.8 mm (2") long that penetrates the full length of the bracer grip 26. Visible from a top of the bracer grip 26 in FIGS. 2B and 2C is a hex screw head with a Phillips screwdriver slot 30. Attached to the bracer grip 26 is a circular shaped bracer disc 24, approximately 3.175 mm (⅛") thick with a diameter of approximately 31.75 mm (1¼") that is greater than the diameter of the threaded screw 28. The bracer disc 24 is also penetrated by the threaded bracer screw 28. This embodiment is meant to enable the use of a Phillips type screwdriver for screwing the bracer 22 into a bonding substrate if not screwing with the bracer grip 26. The threaded bracer screw 28 is comprised of low carbon steel in this embodiment and is available from Armour Screw Company, Elk Grove Village, Ill. Alternative materials for the threaded bracer screw 28 could include stainless steel, brass, nickel alloy, aluminum, alloy or other materials. Screw head 30 can be manufactured to other shapes including round and square. Alternate embodiments for the screwdriver slots [30] can be manufactured to accommodate flat-headed screwdrivers (not shown) and square headed screwdrivers (not shown).

Figure 3:
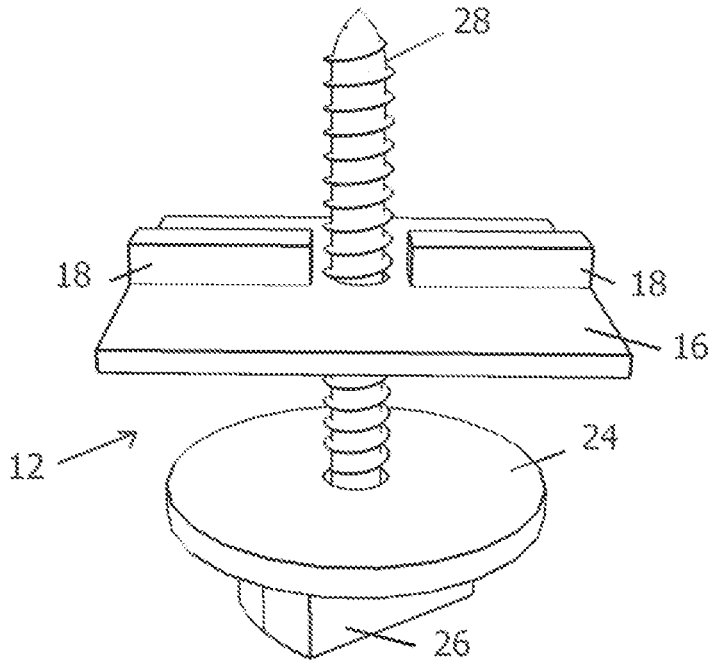
FIG. 3 is a perspective view of the bracer spacer assembled with the spacer in the upright position atop the bracer. The spacer has two spacer ridges located on both sides of a central hole defined in the spacer with the bracer's threaded screw extending therethrough.

FIG. 3 shows a perspective view of the invention assembled with the flat spacer 14 in an upright position atop the bracer 22. The detailed description of the individual parts of this figure has been previously described.

Figure 4:
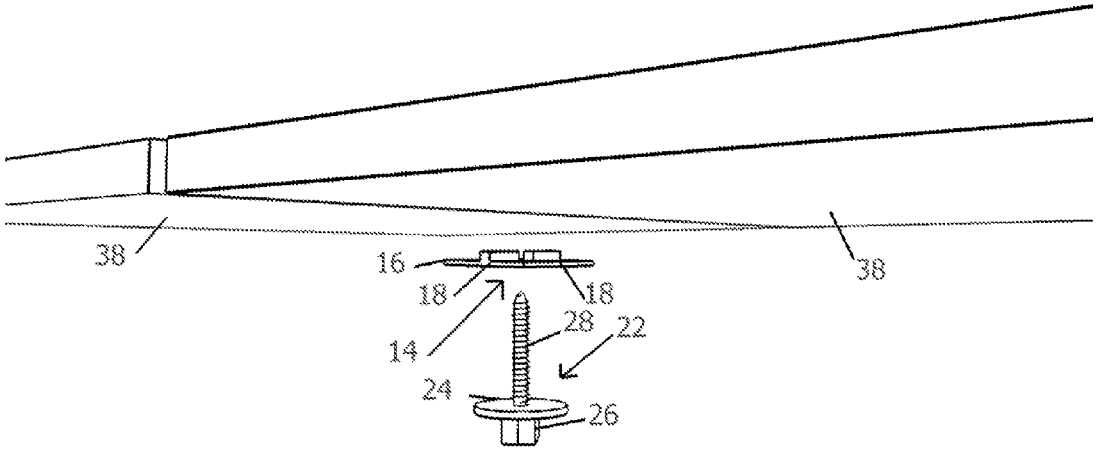
FIG. 4 is an exploded view of the bracer spacer positioned for installation between two tiles on a ceiling.

FIG. 4 shows an exploded view of the bracer 22 and spacer 14 between two tiles 38. The tiles 38 are for illustration purposes and are not part of the invention. The detailed description of both the bracer 22 and the flat spacer 14 in this figure have been fully described previously.

Figure 5:
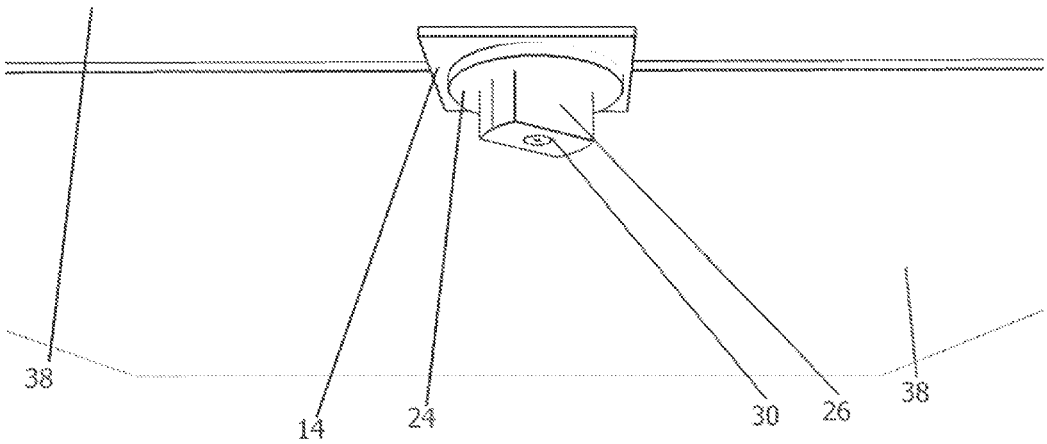
FIG. 5 is a bottom perspective view of the bracer spacer secured between two ceiling tiles held in place with the bracer and spaced with the spacer.

FIG. 5 shows the bracer 22 and spacer 14 fully engaged and holding two ceiling tiles 38 in place with the threaded bracer screw 28 fully engaged with the substrate underlying the tiles 38. The detailed description of both the bracer 22 and the flat spacer 14 in this figure has been fully described previously.

The manner of using the Bracer Spacer 12 in the installation of tiles 38 to ceilings begins with the installation of a bonding substrate. Using a stud finder, an installer will identify and mark the location of ceiling joists. Once that task has been completed, the installer will measure the length and width of the ceiling that will be receiving the bonding substrate. After the measurements are complete, the installer will cut the bonding substrate to size. The bonding substrate—may now be secured to the ceiling with commonly used construction screws including, wood screws and sheetrock screws. As an extra precaution, the installer should apply an adhesive (such as glue) to one side of the bonding substrate and with the sticky side up, secure that side to the ceiling. This enables the bonding substrate to attach more securely to the ceiling. While holding the bonding substrate in place, the installer should ensure that the screws he/she will use to permanently secure the bonding substrate to the ceiling are aligned so they can be screwed directly into the previously located ceiling joists. Afterwards, the installer can go ahead use the screws to attach the bonding substrate to the ceiling. This important step will allow for the most secure attachment of the bonding substrate to the ceiling. It will also reduce the possibility of the bonding substrate pulling away from the ceiling after tiles 38 have been installed on the bonding substrate. After the bonding substrate has been completely attached, the ceiling is ready to receive tile 38. If necessary, the installer will cut the preferred tile 38 to the desired dimensions. Once cut the tile 38 is ready to be put to the ceiling.

The installer should place the spacer 14 atop the bracer 22 with the spacer ridge 18 facing up. Afterwards, the installer will place the assembled, Bracer Spacer 12, in a place where he/she can reach it easily with one hand. While holding or placing a tile 38 on a hard surface, the installer will "back butter" the tile 38 and subsequently move the tile 38 to the desired position on the ceiling. Holding the tile in one hand the installer will push the tile 38 to the ceiling to create a bond with the bonding substrate. The adhesive (not shown) applied to a rear surface of the tiles 38 should be sticky enough to hold the tile 38 to the ceiling without any additional upward pressure. However, the installer should still hold the tile 38 in place to prevent it from pulling away from the ceiling. With his other hand, the installer retrieves the bracer 22, places the bracer 22 immediately adjacent to a middle portion of the tile 38 ensuring that the spacer ridge 18 is aligned parallel to and frictionally contacting the tile 38 being held. The installer then screws the bracer 22 clockwise into the bonding substrate so that the threaded screw 28 penetrates therein until the spacer 14 is snug with the outside/exposed face of the tile 38. This preferred embodiment enables screwing-in of the bracer 22 to be accomplished without a screwdriver by using the bracer grip 26 or with a hand-held or cordless screwdriver. If placed adjacent to the middle edge of a tile 38, only one Bracer Spacer 12 will be required per side. Next, the installer will repeat the same steps on the opposite side of the tile 38. With a spacer 14 on each side of the tile 38, the tile 38 will remain secured to the ceiling substrate and in frictional contact with the adhesive therebetween. The remaining tiles 38 may thereafter be installed in the same manner until the job is complete and the adhesive dries where upon the spacers 14 and the bracers 22 are threadably removed by unscrewing the bracers 22.

Figure 6:
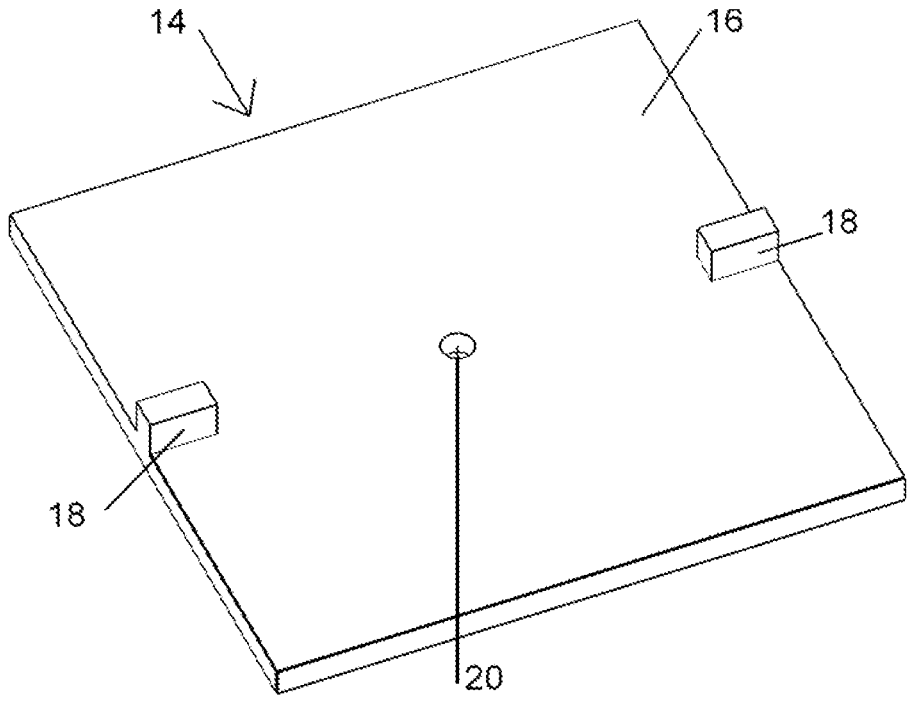
FIG. 6 is a perspective view of an alternative embodiment of the spacer with two spacer ridges on the spacer base at opposite ends of the spacer.

FIG. 6 shows a perspective view of an additional embodiment of the spacer 14. Molded to a center of spacer base 16 are two short spacer ridges 18 that are approximately 4.7625 mm (3/16") long. The two short spacer ridges 18 are located at the middle of the spacer base 16, separated by a hole 20. The spacer ridge 18 width can range from approximately 0.7938 mm (1/32") to 12.7 mm (1/2") wide or greater dependent upon the desired space between adjacent tiles 38. The spacer ridges 18 can be located centrally anywhere and any length on either side of the hole 20. Between each spacer ridge 18 is a round hole 20. The hole 20 has a diameter from 0.3969 mm (1/64") to 12.3031 mm (31/64") or greater dependent upon the size of the screw 28 that will penetrate the hole 20. The screw 28 is always slightly smaller than the width of the spacer ridge 18.

Figure 7:
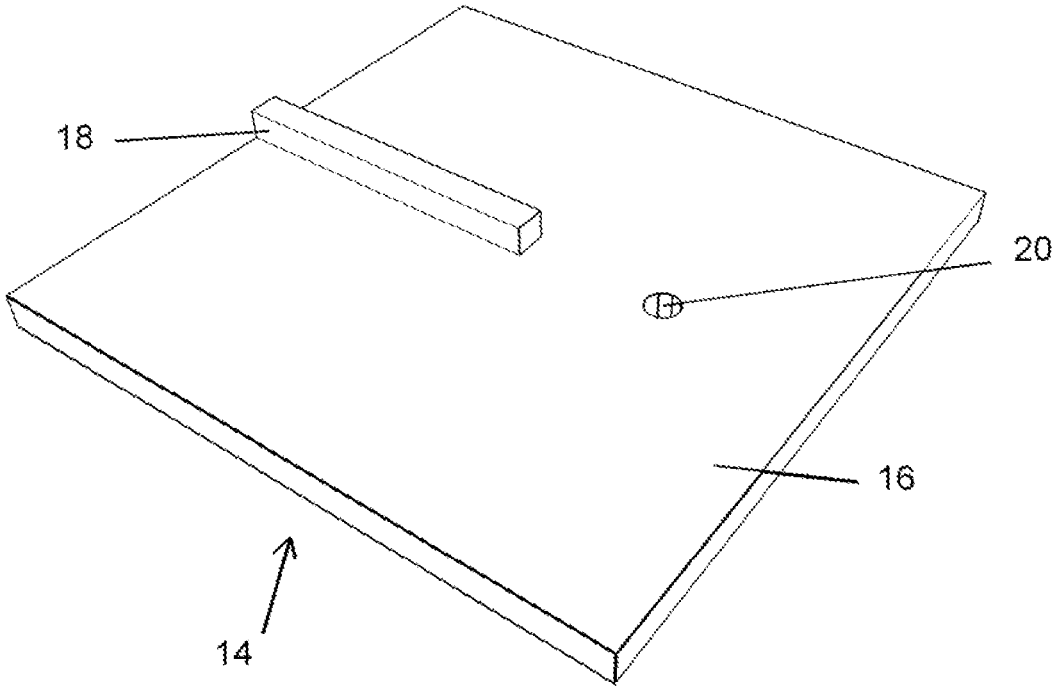
FIG. 7 is a perspective view of an alternative embodiment of the spacer with one spacer ridge on the spacer base.

FIG. 7 shows a perspective view of an additional embodiment of the spacer 14 having one spacer ridge 14 approximately 19.05 mm (3/4") long starting at the center of the spacer base 16 and extending to the end of the spacer base 16. The spacer ridge 18 width can range from approximately 0.7938 mm (1/32") to 12.7 mm (1/2") wide or greater dependent upon the desired space between adjacent tiles 38. A centrally located hole 20 is located at the middle of the remaining half of the spacer base 16. The hole 20 has a diameter from 0.3969 mm (1/64") to 12.3031 mm (31/64") or greater dependent upon the size of the screw 28 that will penetrate the hole. The screw 28 is always slightly smaller than the width of the spacer ridge 18.

Figure 8:
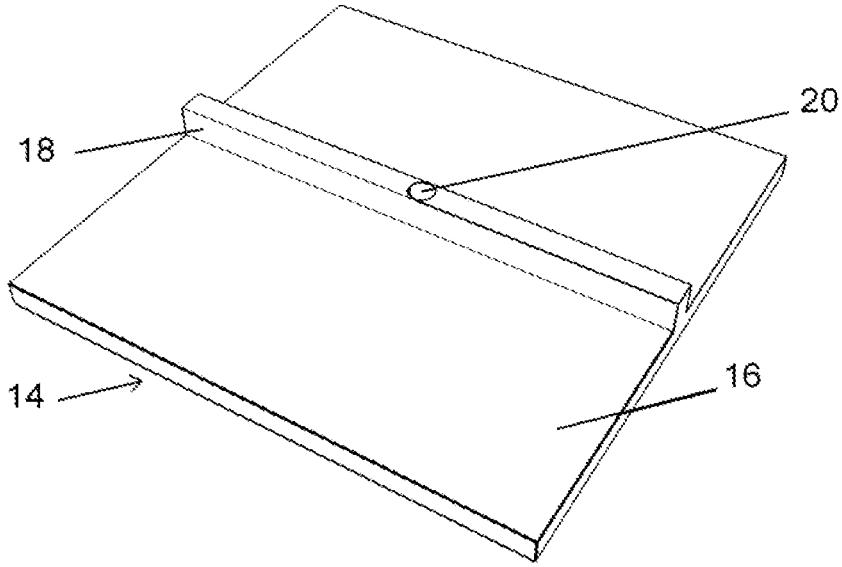
FIG. 8 is a perspective view of an alternative embodiment of the spacer with a centrally located spacer ridge extending across the entire width of the spacer with a hole in the spacer ridge.

FIG. 8 shows a perspective view of an additional embodiment of the spacer 14 having one spacer ridge 14 approximately 38.1 mm (1 1/2") long centrally located starting at one end of the spacer base 16 and extending across to the other end of the spacer base 16. The spacer ridge 18 width can range from approximately 0.7938 mm (1/32") to 12.7 mm (1/2") wide or greater dependent upon the desired space between adjacent tiles 38. A centrally located hole 20 is located at the middle spacer ridge 18 that goes all the way through the spacer ridge 18 and the spacer base 16. The hole 20 has a diameter from 0.3969 mm (1/64") to 12.3031 mm (31/64") or greater dependent upon the size of the screw 28 that will penetrate the hole 20. The screw 28 is always slightly smaller than the width of the spacer ridge 18.

Figure 9:
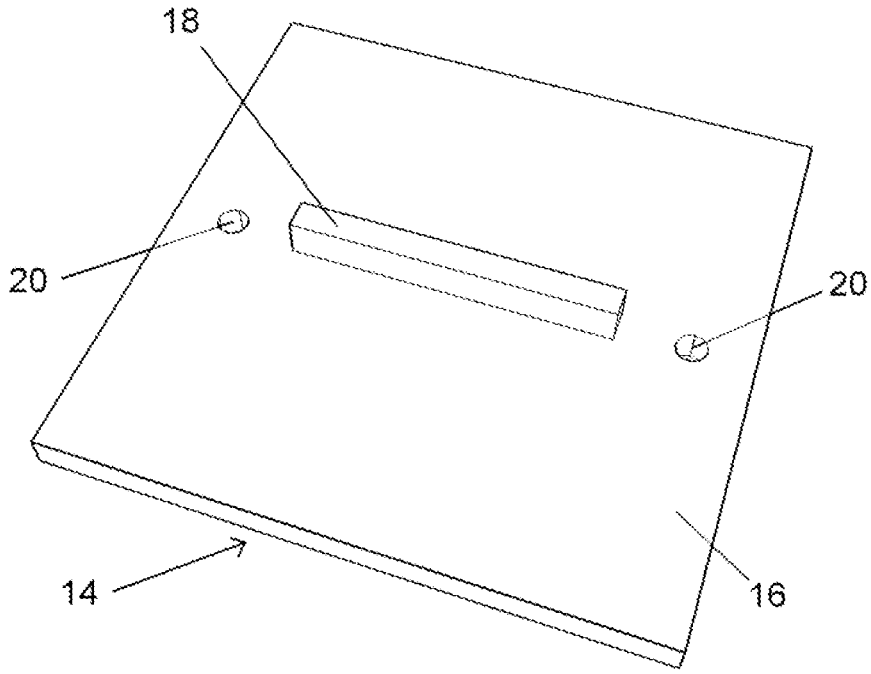
FIG. 9 is a perspective view of an alternative embodiment of the spacer with one spacer ridge with holes defined in the spacer adjacent each end of the spacer ridge.

FIG. 9 shows a perspective view of an additional embodiment of the spacer 14 having one spacer ridge 18 approximately 10 mm (3/8") at the center of the spacer base 16 and 6.4 mm (1/4") from each end. The spacer ridge 18 width can range from approximately 0.7938 mm (1/32") to 12.7 mm (1/2") wide or greater dependent upon the desired space between adjacent tiles 38. Two centrally located holes 20 are located at the middle of the space adjacent to the ends of the spacer ridge 18. Each hole 20 has a diameter from 0.3969 mm (1/64") to 12.3031 mm (31/64") or greater dependent upon the size of the screw 28 that will penetrate the hole 20. The screw 28 is always slightly smaller than the width of the spacer ridge 18.

The difference in the operation of additional embodiments described in FIGS. 6-9 is that in FIG. 8 the threaded bracer screw 28 will be inserted directly through the hole 20 which will also go through the spacer ridge 18.

In FIG. 9 the spacer 14 has two holes 20 which require two threaded bracer screws 28 instead of one.

Figure 10A:
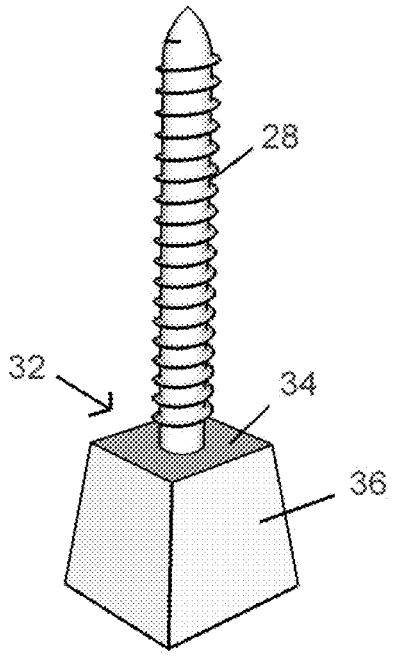
FIG. 10A is a perspective view of an alternative embodiment of the bracer.
Figure 10B:
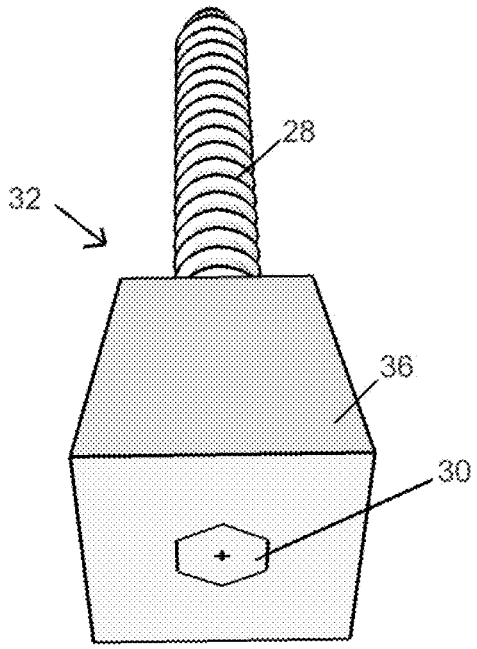
FIG. 10B is a perspective view of an alternative embodiment of the bracer.

FIGS. 10A and 10B shows a perspective view of another embodiment of an angled bracer 32. This embodiment shows a slightly angled bracer 32 with a flat bracer face 34 and a threaded bracer screw 28 extruding the body of the bracer 32. On the opposite side of the body is a hex screw head with Phillips screwdriver slot 30. The angled bracer 32 is preferably comprised of high density polyethylene, available from U.S. Plastic Corporation. The angled bracer 32 may consist of other plastics and hard material such as polypropylene, wood, iron, steel, aluminum, compressed cardboard or other similar materials. Molded into the center of the body of the angled bracer 32 is a threaded bracer screw 28 that penetrates the full length of the body of the angled bracer 32. This embodiment is meant to enable the use of a Phillips type screwdriver for screwing into a bonding substrate when not screwing by using the angled bracer grip 36. The threaded bracer screw 28 may be comprised of low carbon steel in this embodiment and is available from Armour Screw Company, Elk Grove Village, Ill. Alternate materials for the threaded bracer screw 28 could include stainless steel, brass, nickel alloy, aluminum alloy or other materials. The hex screw head 30 may also be manufactured to other shapes including star, hex and square. Other embodiments for the screwdriver slots may also be manufactured to accommodate a variety of screwdrivers.

Using the angled bracer 32 in FIGS. 10A-10B is exactly the same as the procedure for using the bracer 22 The difference is in the design. The body of the angled bracer enables the angled bracer to be gripped easily manually. at least one embodiment of my Bracer Spacer 12 provides a simple, safe, predictable, repeatable and economical device that can be used by professionals and amateur installers to assist in the installation of tiles on a ceiling.

While the above description contains many specifics, these should not be construed as limitations in the scope, but rather as an exemplification of one (or several) embodiment(s). Many other variations are possible. For example, the bracer and spacer are ideally suited for the installation of ceiling tile; however, the spacer may also be used on floors and walls as a commonly used spacer and when used in conjunction with the bracer as a method to level tiles as well. Installers may use my invention to space adjacent tiles as little as 0.7938 mm ("1/32") apart, or as great as 19.05 mm ("3/4") or larger on big walls and floors, because my inventions can be manufactured in a variety of dimensions. The bracer screw 28 can be specially manufactured and modified to dimensions from. 7938 mm {"1/32"} to 19.05 mm ("3/4"), or greater, if desired. The spacer ridge 18 can range from 0.7938 mm ("1/32") to 19.05 mm ("3/4"), depending upon the distance desired between adjacent tiles. Various shapes of the Bracer Spacer 12 include square, rectangle, triangle, parallelogram, circle or nearly any conceivable shape as long as there is enough material to securely hold the tile 38 being installed The size, shape and color of respective embodiments will not adversely impact the function, nor the intended purpose of this embodiment of the Bracer Spacer 12. Another versatile aspect of the Bracer Spacer 12 is that it may be made from practically any hard material including plastic, wood, ceramics, steel, iron, compressed paper, aluminum, fiberboard or other materials.

If the intent of the installer is to both and simultaneously space and brace ceiling tiles during installation of the tiles as described herein, the elements of my invention are necessary. For example, without a ridge 18, such a spacer is nothing more than a flat disc which would be useful for bracing tiles and not for spacing tiles.

There are many possibilities regarding the positioning of the spacer ridge 18 and the hole 20 on the spacer base 16. Commonality exists in that at least one hole 20 and one spacer ridge 18 is necessary. There has to be enough room at the end of the spacer 14 that extends away from both the hole 20 and the spacer ridge 18 to hold the tile 38 in place. It is preferred that both the hole 20 and the spacer ridge 18 be centered lengthwise on the spacer 14.

I claim:

1. A tile installing device for bracing, spacing and leveling tiles during installation on a ceiling substrate comprising in combination:

a bracer having an elongate threaded substrate penetrating screw with a tapered first end portion for penetrating a substrate and an opposing second end portion, the second end portion carrying a twisting means for rotating the screw axially to penetrate the substrate, the twisting means having a diameter greater than a diameter of the threaded screw;

a spacer having a first surface and an opposing second surface and defining a through hole communicating between the first surface and the second surface, the through hole having a diameter larger than the diameter of the threaded screw and smaller than the diameter of the twisting means for the threaded screw to extend therethrough to removably threadably engage with the ceiling substrate to positionally maintain the tiles in an adhesive between the first surface of the spacer and the substrate, the spacer having a ridge carried on and extending generally perpendicularly from the spacer first surface, the ridge having a side-to-side width equal to a distance adjacent tiles are spaced from one another when installed on the substrate.

2. The tile installing device of claim 1, wherein: the spacer is flat on one surface.

3. The tile installing device of claim 1, wherein: a width of said spacer ridge provides equal distance between adjacent tiles.

4. The tile installing device of claim 1, wherein: the bracer twisting means comprises a radially enlarged grip having a flat surface proximate the tapered end portion of the threaded screw for frictional engagement with the spacer, and a configuration for manual grasping by a user opposite the tapered end portion of the threaded screw.

5. The tile installing device of claim 1, wherein: the threaded substrate penetrating screw is formed of metal.

6. The tile installing device of claim 1, wherein: the threaded screw is integrally molded with the twisting means.

7. The tile installing device of claim 1 further comprising: a screw driver slot defined in the twisting means opposite the tapered first end portion of the threaded screw.

8. The tile installing device of claim 7 wherein: the screwdriver slot is a straight slot for a regular screwdriver.

9. The tile installing device of claim 8 wherein: the plural ridges carried on the first surface of the spacer extend at right angles from one another.

10. The tile installing device of claim 7 wherein: the screwdriver slot is a Phillips type screwdriver slot.

11. The tile installing device of claim 7 wherein: the screwdriver slot is a square shaped driver type screwdriver slot.

12. The tile installing device of claim 7 wherein: the screwdriver slot is a hex head shaped driver slot.

13. The tile installing device of claim 7 wherein: the screwdriver slot is a star shaped driver slot.

14. The tile installing device of claim 1 further comprising: plural ridges carried on the first surface of the spacer.

* * * * *